US010030463B2

(12) United States Patent
Hood et al.

(10) Patent No.: US 10,030,463 B2
(45) Date of Patent: Jul. 24, 2018

(54) APPARATUS WITH WIRED ELECTRICAL COMMUNICATION

(71) Applicant: AKER SUBSEA LIMITED, Maidenhead, Berkshire (GB)

(72) Inventors: Kenneth Hood, Maidenhead (GB); Stuart Reid, Maidenhead (GB); Daniel Ahrens, Maidenhead (GB)

(73) Assignee: AKER SOLUTIONS LIMITED, London (GB)

( * ) Notice: Subject to any disclaimer, the term of this patent is extended or adjusted under 35 U.S.C. 154(b) by 288 days.

(21) Appl. No.: 14/876,286

(22) Filed: Oct. 6, 2015

(65) Prior Publication Data

US 2016/0100497 A1 Apr. 7, 2016

(30) Foreign Application Priority Data

Oct. 7, 2014 (GB) ..... 1417753.9

(51) Int. Cl.
*E21B 33/035* (2006.01)
*E21B 33/037* (2006.01)
*E21B 33/038* (2006.01)

(52) U.S. Cl.
CPC ..... *E21B 33/0385* (2013.01)

(58) Field of Classification Search
CPC . E21B 33/0385; E21B 33/0355; E21B 33/037
See application file for complete search history.

(56) References Cited

U.S. PATENT DOCUMENTS 4,542,260 A * 9/1985 Pearce ..... B29C 70/72 174/524
8,493,741 B2 * 7/2013 Davis ..... E21B 33/0355 174/70 S
8,498,125 B2 * 7/2013 Hall ..... E21B 47/011 361/735
8,978,817 B2 * 3/2015 Rodgers ..... G10K 11/16 181/207
2004/0175092 A1 * 9/2004 Young ..... G02B 6/4201 385/138

(Continued)

FOREIGN PATENT DOCUMENTS

| | | |
|---|---|---|
| EP | 2 467 005 | 6/2012 |
| GB | 2477714 | 8/2011 |
| WO | WO 2011/071475 | 6/2011 |

OTHER PUBLICATIONS

Search Report for GB 1417753.9, dated Jan. 29, 2015, 7 pages.
Aker Solutions, "Subsea Control Systems", SubseaWeb—open systems architecture, Control Systems: the next generation, 12 pages.

*Primary Examiner* — Matthew R Buck
(74) *Attorney, Agent, or Firm* — Nixon & Vanderhye P.C.

(57) ABSTRACT

An apparatus for use subsea includes a container having at least one aperture; a lid securable to the container to cover the at least one aperture, suitable to isolate the inside of the container from the outside of the container when fluid pressure outside the container is at least 5000 kPa. The lid has one or more electrical connections providing electrical communication from a first side of the lid to a second side of the lid. The apparatus further includes one or more wires for providing electrical communication between one or more electrical components in the container and the one or more electrical connections in the lid.

20 Claims, 7 Drawing Sheets

(56) References Cited

U.S. PATENT DOCUMENTS

| | | | | |
|---|---|---|---|---|
| 2012/0120963 | A1* | 5/2012 | Davis | E21B 33/0355 370/401 |
| 2012/0152559 | A1 | 6/2012 | Knox | |
| 2012/0314373 | A1* | 12/2012 | Park | H05K 7/1434 361/715 |
| 2014/0013837 | A1* | 1/2014 | Lee | G01L 5/0004 73/152.59 |
| 2014/0048274 | A1 | 2/2014 | Reynolds et al. | |

* cited by examiner

APPARATUS WITH WIRED ELECTRICAL COMMUNICATION

This application claims priority to GB 1417753.9 filed 7 Oct. 2014, the entire contents of which is hereby incorporated by reference.

TECHNICAL FIELD

The present invention relates to an apparatus for use subsea. The present invention relates to subsea equipment and particularly subsea equipment used to control and monitor subsea oil and gas wells. The subsea equipment may be part of a subsea tree.

BACKGROUND

Subsea Control Modules (SCM's) are commonly used in the oil and gas industry. Most SCM's have a plate for attaching the SCM to a subsea tree, a sealed electronics chamber and a series of valves that can be used to control fluid and electrical lines that pass through the tree and into a well. The sealed electronics chamber is often referred to as a Subsea Electronics Module (SEM).

There are many different designs of SEM's but most comprise an opened ended canister and a cap that fits onto and closes the canister. The cap has an electrical connector with electrical connections that provide electrical communication between electrical components inside the canister and the outside.

BRIEF SUMMARY

The inventors of the present invention are aware that the number of electrical connections that can be made between the inside and the outside of the canister is limited to the number of electrical connections in the electrical connector.

In accordance with a first aspect of the present invention there is provided an apparatus for use subsea, the apparatus comprising:

- a container having at least one aperture;
- a lid securable to the container to cover the at least one aperture, suitable to isolate the inside of the container from the outside of the container when fluid pressure outside the container is at least 1000 kPa, optionally 5000 kPa;
- the lid having one or more electrical connections providing electrical communication from a first side of the lid to a second side of the lid; and
- one or more wires for providing electrical communication between one or more electrical components in the container and the one or more electrical connections in the lid.

It may be an advantage of the present invention that when the one or more wires of the apparatus for use subsea are connected to the one or more electrical connections in the lid, the lid can be moved relative to the container whilst the electrical communication is maintained. Movement of the lid relative to the container may be limited but importantly it allows the one or more wires to be connected to the one or more electrical connections in the lid before the lid is secured to the container, and the container is prepared for deployment subsea.

The apparatus may be a Subsea Electronic Module (SEM). Typically this can be used to control fluid, electrical lines and or other lines that pass through the tree and into a well. The pressure inside the container may be from 100 to 200 kPa. The lid may have one or more ports so that the atmosphere inside the container can be controlled from outside the container.

The apparatus is suitable for use subsea, that is, its inside can be isolated from its outside when the outside pressure is at least 1000 kPa, or 5000 kPa that is in a depth of around 500 m.sw (meters of sea water). This is a significant force (10 or 50 times atmospheric pressure) and so clearly distinguished from surface equipment. Indeed, normally it is rated to be used at greater depths, and pressures. For example, rated to a pressure more than 10,000 kPa, or more than 20,000 kPa, and up to a pressure outside the container of 30,000 kPa (or 40,000 kPa) typically equal to a pressure at a depth of 3,000 (or 4,000 respectively) m.sw (meters of sea water). The lid may be securable to the container to cover the at least one aperture thereby isolating inside from outside the container when fluid pressure outside the container is up to 45,000 kPa. The pressure outside the container of 45,000 kPa is typically equal to a pressure at a depth of 4,500 m.sw (meters of sea water).

The apparatus may be operable at temperatures of from −40° C. to +150° C.

The container may be cylindrical. When the apparatus is assembled the first side of the lid is normally innermost and/or inside the container and the second side of the lid is normally outermost and/or forms part of an outer surface of the apparatus. When the lid is secured to the container the container may be referred to as being sealed and/or air-tight. Normally the apparatus is gas filled, for example with dry nitrogen.

The one or more wires are typically up to 300 mm long, normally up to 200 mm long and usually up to 100 mm long. Typically the one or more wires are from 125 mm up to 191 mm long. The one or more wires may be in the form of a cable. The cable is typically a flexible cable. The cable is normally a ribbon cable. It may be an advantage of the present invention that the one or more wires, particularly the ribbon cable can provide electrical communication for many electrical signals to be transmitted between the one or more electrical components in the container and electrical connections in the lid.

The container may have a first and a second aperture. The first and second apertures may be at opposing ends of the container. When the container is cylindrical the container may be a hollow tube. The container may be referred to as a canister When the container has a first and a second aperture, the apparatus typically comprises a second lid. The lid of the apparatus according to the first aspect of the present invention may be referred to as a first lid. The first and second lids may be the same or may be different. The second lid is typically securable to the container to cover the second aperture, thereby isolating inside from outside the container. The second lid typically has one or more electrical connections providing electrical communication from a first side of the lid to a second side of the lid. The first and/or second lid may be referred to as a bulkhead.

The electrical connections in the first and/or second lid are typically sealed and/or air-tight, that is air, water and/or other fluid cannot pass from the first side of the lid to the second side of the lid and vice versa, when fluid pressure outside the container is for example up to 40,000 kPa, and may be up to 45,000 kPa.

The first and/or second lid normally has a flange on the first side. This flange is typically engageable with a corresponding flange on the container near the first and/or second aperture. The first side of the first and/or second lid may comprise at least one seal. The at least one seal typically extends around a surface of the lid so that when the surface is inside the container, the at least one seal may be contactable with an inner surface of the container near the first and/or second aperture. The at least one seal may provide isolation between inside and outside the container when fluid pressure outside the container is for example up to 40,000 kPa, and may be up to 45,000 kPa.

When the first and/or second lid includes a first and a second seal, the first seal may be referred to as a face seal and the second seal may be referred to as a barrel seal. The face seal may be contactable with an inner surface of the container near the first and/or second aperture. The barrel seal may be contactable with the corresponding flange on the container near the first and/or second aperture.

The apparatus typically includes one or more backplanes for providing electrical communication between the one or more electrical components in the container and/or the one or more electrical connections in the second lid. The apparatus may further include one or more backplanes for providing electrical communication between the one or more electrical components in the container. The one or more backplanes may be rigid, semi-rigid, flexi-rigid or flexible.

The one or more wires typically have a first and a second end. The first end of the one or more wires normally terminates and/or is in electrical communication with one or more electrical connectors. The one or more electrical connectors are typically female connectors. The lid typically has one or more corresponding male connectors, onto which the one or more female connectors are securable, such that electrical communication can be established through the one or more wires, the one or more female and one or more male connectors and one or more electrical connections in the lid.

The second end of the one or more wires is typically attached and/or in electrical communication with the one or more electrical components. The second end of the one or more wires may be attached and/or in electrical communication with the one or more backplanes for providing electrical communication between the one or more electrical components in the container.

The one or more electrical connections in the first and/or second lid may terminate on the second side of the first and/or second lid in an electrical penetrator. The electrical penetrator typically comprises a body housing an aperture containing one or more conducting pins that are in electrical communication with the one or more electrical components in the container via the one or more wires or one or more backplanes. The electrical penetrator of the first and second lid may be the same. The electrical penetrator of the first and/or second lid may be a wet- or dry-mateable connector. The electrical penetrator of the first and/or second lid is normally part, typically an integral part of the first and/or second lid.

The electrical penetrator of the first and/or second lid is typically an interface or at least part of an interface between inside and the outside of the container.

The electrical penetrator of the first and/or second lid typically has more than 100, normally more than 200, and may be 267 conducting pins in electrical communication with the one or more electrical components in the container via the one or more wires and/or one or more backplanes. When the container of the apparatus has first and second apertures and first and second lids, the electrical penetrator of the first lid typically has more than 100, normally more than 200, and may be 267 conducting pins and the electrical penetrator of the second lid typically has more than 100, normally more than 200, and may be 267 conducting pins. Both electrical penetrators are typically in electrical communication with the one or more electrical components in the container via the one and/or more wires or one or more backplanes.

It may be an advantage of the present invention that when the container of the apparatus has first and second apertures and first and second lids, the apparatus has two electrical penetrators, one on the first lid and one on the second lid. Having two electrical penetrators means the apparatus can have double the conventional number of conducting pins, that is typically more than 200, normally more than 400, and may be 534 conducting pins. It may be a further advantage of the double or additional number of conducting pins that the apparatus has the capacity to fit extra electrical connections and this is especially desirable for high data applications such as condition monitoring.

Each conducting pin can communicate or transmit an electrical signal. The more conducting pins the apparatus has, the more electrical signals can be communicated or transmitted between inside and outside the container. Each electrical signal may be or may be part of a monitoring or control signal. A monitoring signal is typically a signal sent from the one or more electrical components in the container to the outside. The signal may for example include information about one or more of temperature, pressure, other subsea conditions or the position of valve or actuator located subsea. A control signal is typically a signal sent from outside the container to the one or more electrical components in the container. The signal may for example include an instruction to the one or more electrical components to open a valve or activate an actuator.

Increasing the number of electrical signals that can be communicated or transmitted, increases the functionality of the apparatus, that is more electrical components can be put into the container and/or the more electrical signals can be communicated or transmitted between inside and outside the container.

A preferred embodiment of the apparatus of the present invention typically comprises a container with a first and a second aperture and a first and a second lid, the first lid including an electrical penetrator and securable to the container to cover the first aperture and the second lid including an electrical penetrator and securable to the container to cover the second aperture, thereby isolating inside from outside the container when fluid pressure outside the container is for example up to 40,000 kPa.

The one or more electrical components in the container may include a Printed Circuit Board (PCB). The Printed Circuit Board may be a Digital Processing Card (DPC). The apparatus may include a plurality of Printed Circuit Boards (PCBs). The apparatus may include up to four PCBs or more. There may be a connector, typically two connectors, attached to each PCB. The two connectors are typically attached to opposite ends of each PCB. The connector or typically two connectors are normally directly attached and/or hard-wired to the each PCB.

The apparatus may further comprise a corresponding connector or two corresponding connectors to provide electrical communication between the connector or two connectors attached to each PCB and the one or more wires or one or more backplanes. The corresponding connector or two corresponding connectors may be particularly suited to use in harsh environments. The corresponding connector or typically two corresponding connectors may be a Hypertac (TM) or Smith(TM) type connector.

The connector, typically two connectors, attached to each PCB may be male-type connectors. The corresponding connector or two corresponding connectors may be female-type connectors. The connector and corresponding connector and typically two connectors and two corresponding connectors are usually screwed together.

The one or more wires for providing electrical communication between the one or more electrical components in the container and the one or more electrical connections in the lid, may also provide electrical communication between the one or more Printed Circuit Boards (PCBs) and in particular the one or more Digital Processing Cards (DPC's). The one or more wires may be attached to and thereby provide electrical communication between and/or from the corresponding connectors. The PCBs and in particular the DPC's are often different lengths due to manufacturing tolerances, and it may be an advantage of the present invention that compared to a rigid connection, the flexibility of the one or more wires will make allowance for any tolerance build-up and ensure reliable electrical contact and communication between the corresponding connectors, DPC's and PCBs. This may be particularly useful when there are electrical connectors at both opposite ends of each PCB and/or DPC.

BRIEF DESCRIPTION OF THE DRAWINGS

An embodiment of the invention will now be described by way of example only and with reference to the accompanying drawings, in which.

DETAILED DESCRIPTION OF EXAMPLE EMBODIMENTS

Figure 1:
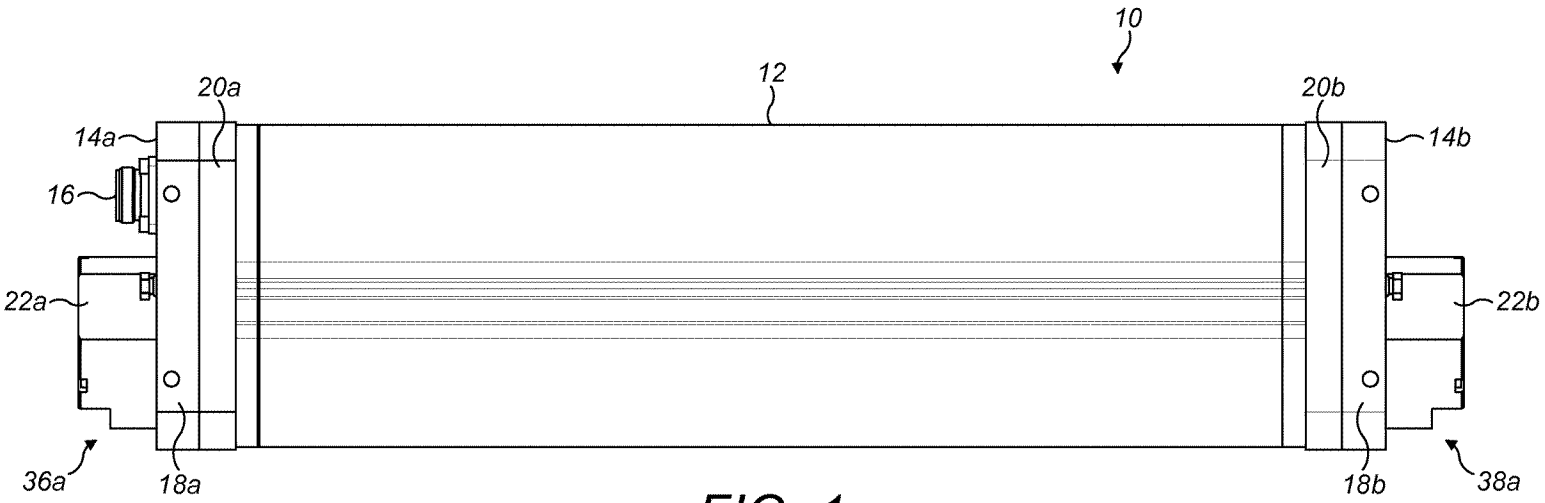
FIG. 1 is a perspective view of a container with lids according to an embodiment of the present invention.

FIG. 1 is a perspective view of the apparatus 10 for use subsea. The apparatus 10 includes a container, or canister 12, with first and second apertures (not shown) and first and second lids 14*a*,14*b* are secured to the canister 12 to cover the two apertures thereby isolating inside from outside of the canister 12 when the fluid pressure outside the canister 12 is at least 1000 kPa. The apparatus 10 and in particular the lids 14*a* and 14*b*, also include a penetrator 22*a*,22*b* at each end of the canister 12.

The first and second lids 14*a*,14*b* each have 267 electrical connections, or conducting pins (not shown), to provide electrical communication from a first side (not shown) of each lid 14*a*,14*b* to a second side 36*a*,38*a* of each lid 14*a*,14*b*.

The 267 conducting pins in both the first and second lids 14*a*,14*b* terminate on the second side 36*a*,38*a* of both the first and second lids 14*a*,14*b* in electrical penetrators 22*a*, 22*b*.

When the apparatus 10 is assembled, the first side of each lid 14*a*,14*b* is the innermost and sits inside the canister 12; and the second side 36*a*,38*a* of each lid 14*a*,14*b* is the outermost and forms part of an outer surface of the apparatus 10. When each lid 14*a*,14*b* is secured to the canister 12 the canister is sealed and air-tight.

The first and second lids 14*a*,14*b* each have a flange 18*a*,18*b* on the first side. Each flange 18*a*,18*b* aligns with a corresponding flange 20*a*,20*b* on the canister 12 near the first and second apertures. The first and second lids 14*a*,14*b* are attached to the canister 12 via screw holes (not shown) in each flange 18*a*,18*b*,20*a*,20*b*.

The first lid 14*a* is secured to the canister 12 to cover the first aperture and the second lid 14*b* is secured to the canister 12 to cover the second aperture, thereby isolating inside from outside the canister 12 when fluid pressure outside the canister 12 is at least 1000 kPa.

Figure 2:
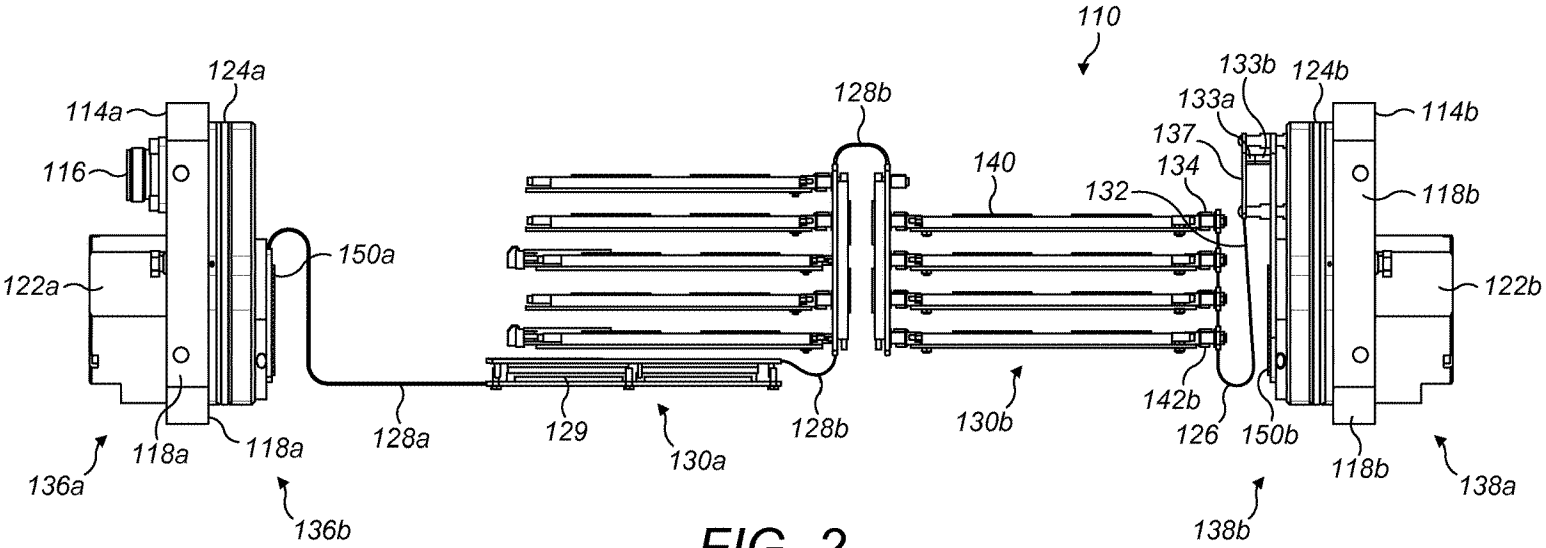
FIG. 2 is a perspective view of electrical components inside the container.

FIG. 2 is a perspective view of the apparatus with the canister removed to reveal the electronic components inside. Where the features are the same as in FIG. 1, they are labelled with the same number, prefixed by "1".

The first side 136*b*,138*b* of the first and second lids 114*a*,114*b* has a face seal 124*a*,124*b* and a barrel seal (not shown). The face seals 124*a*,124*b* extend around a surface of each lid 114*a*,114*b* so that when the surface is inside the canister, the face seals 124*a*,124*b* are in contact with an inner surface of the canister (not shown) near the first and second apertures.

The first lid 114*a* is attached to a chassis (not shown). The first and second lids 114*a*,114*b* comprise flanges 118*a*,118*b* respectively.

The apparatus 110 has a ribbon cable 126 for providing electrical communication between the electrical component 130*b* and the 267 electrical connections in the second lid 114*b*. In an alternative embodiment the apparatus 110 may further contain two ribbon cables 128*a*, 126 for providing electrical communication between the electrical components 130*a*, 130*b* and the 267 electrical connections in each lid 14*a*,14*b* respectively.

When the ribbon cable 126 is connected to the 267 conducting pins in the second lid 114*b*, the lid 114*b* can be moved relative to the canister (not shown) whilst the electrical communication and/or connection is maintained. This allows the ribbon cable 126 to be connected to the 267 conducting pins in the lid 114*b* before the lid 114*b* is secured to the canister (not shown).

The ribbon cable 126 is 150 mm long and is flexible. The ribbon cable 126 provides electrical communication for many electrical signals to be transmitted between the second electrical component 130*b* in the canister and the conducting pins 150*b* in the second lid 114*b*.

The apparatus 110 includes backplanes 128*a* & 128*b* to provide electrical communication between the first and second electrical components 130*a*,130*b* in the canister and the 267 conducting pins 150*a* in the first lid 114*a*. The backplane 128*b* is semi-rigid. The backplane 128*a* is 206 mm long and is flexible. In the alternative embodiment when the apparatus has two ribbon cables 128*a*, 126, the ribbon cable 128*a* is 206 mm long and is flexible.

The first lid 114*a* contains 267 conducting pins 150*a*. The 267 conducting pins in the first lid 114*a* terminate in an electrical penetrator 122*a*. The second lid 114*b* contains 267 conducting pins 150*b*. The 267 conducting pins 150*b* in the second lid 114*b* terminate in an electrical penetrator 122*b*. The electrical penetrators 122*a*,122*b* of the first and second lids 114*a*,114*b* are the same.

The electrical penetrators 122*a*,122*b* of the first and second lids 114*a*,114*b* each have 267 conducting pins 150*a*, 150*b* in electrical communication with the electrical components 130*a*,130*b* in the canister via the ribbon cable 126 and backplanes 128*a*,128*b* respectively.

The ribbon cable 126 has a first 132 and a second 134 end. The first end 132 of the ribbon cable 126 terminates with one female electrical connector 133*a*. The second lid 114*b* has one corresponding male connector 133*b*, onto which the female connector 133*a* is secured, such that electrical communication is established through the ribbon cable 126, the one female 133*a* and one male 133*b* connector and the 267 conducting pins 150*b* in the second lid 114*b*.

The 267 conducting pins 150*a* on the first lid 114*a* are attached to the flexible backplane 128*a*. The 267 conducting pins 150*b* on the second lid 114*b* are attached to the male connector 133*b* on the first end 132 of the ribbon cable 126. The male connector 133*b* is mounted on a rigid board 137.

The second end 134 of the ribbon cable 126 is attached and in electrical communication with the second electrical component 130*b*. The second end 134 of the ribbon cable 126 is in electrical communication with electrical connectors 142*b* of the second electrical component 130*b*. The second end 134 of the ribbon cable 126 is in electrical communication with the first and second electrical components 130*a*, 130*b* through the backplanes 128*a*, 128*b*.

Electrical communication between the electrical components 130*a*,130*b* is provided by the backplane 128*b*. The second end 134 of the ribbon cable 126 is in electrical communication with the first electrical component 130*a* via the backplane 128*b*.

The electrical communication referred to herein may also or alternatively be referred to as electrical contact.

The second electrical component 130*b* in the canister includes four Digital Processing Cards (DPC's) 140. The second electrical component 130*b* is referred to as the "DPC side".

The ribbon cable 126 also provides electrical communication between the DPC's 140. The ribbon cable 126 is attached to and thereby provides electrical communication between and from the corresponding connectors 133*a*,133*b*.

Figure 3:
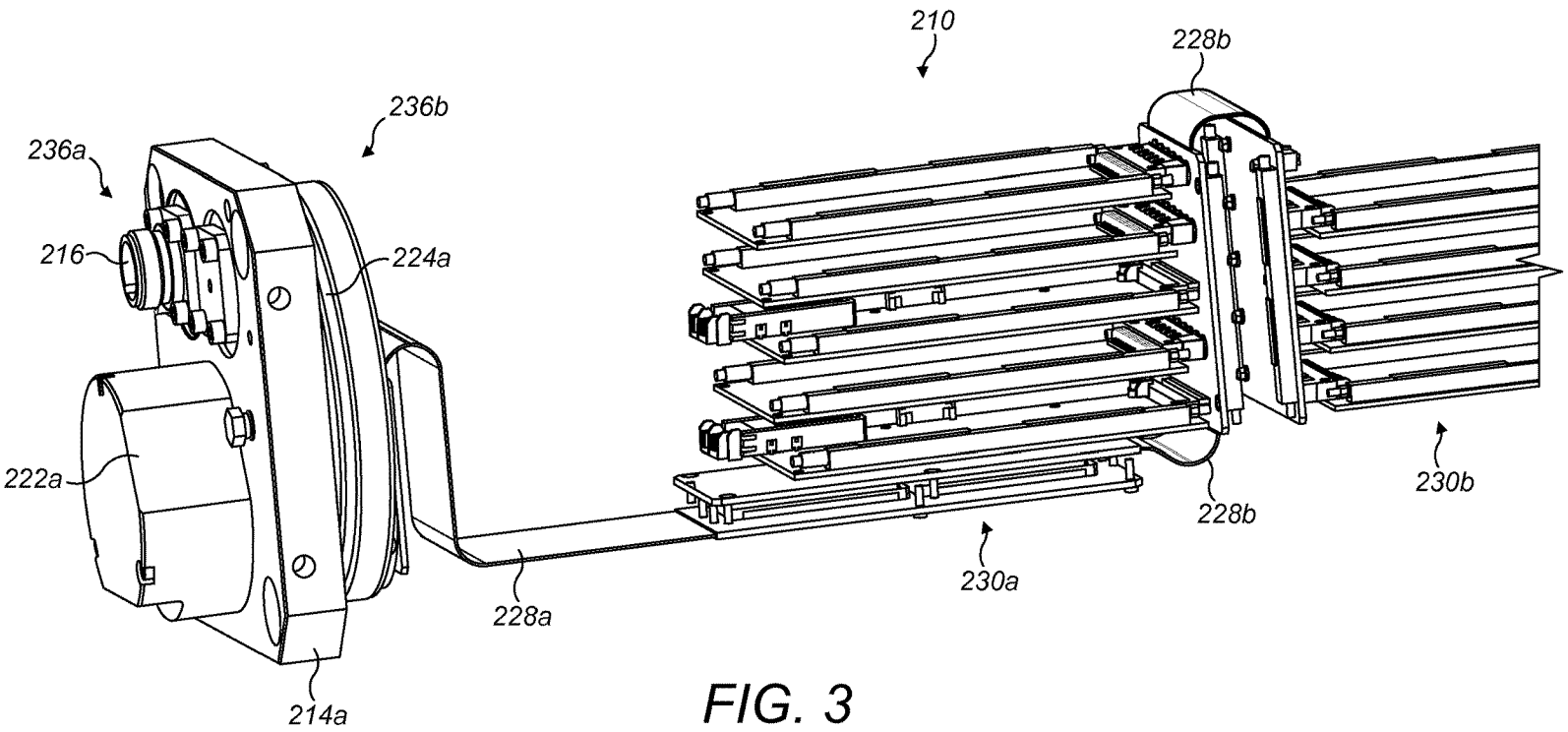
FIG. 3 is a perspective view of electrical components at one end of the container.

FIG. 3 is a perspective view of the penetrator and electrical components at the left hand side of the apparatus with the canister removed.

The first lid 214*a* contains 267 conducting pins which terminate on the second side 236*a* of the first lid 214*a* in the electrical penetrator 222*a*. The electrical penetrator 222*a* comprises a body housing an aperture containing the 267 conducting pins that are in electrical communication with the electrical component 230*a* in the canister via the backplane 228*a*. The electrical penetrator 222*a* of the first lid 214*a* is a dry-mateable connector. The electrical penetrator 222*a* of the first lid 214*a* is an integral part of the first lid 214*a*.

The electrical penetrators 222*a* of the first lid 214*a* is an interface between the inside and the outside of the canister.

The apparatus 110 also has a rigid portion 129 of two flex-rigid portions fixed together. The rigid portion 129 fits under the left hand circuit stack of electrical components 130*a*. The rigid portion 129 increases the length of the backplane 128*a* without increasing its overall size. The backplane 128*a* may be referred to as a flex/rigid circuit. The two flex-rigid portions are portions of backplane.

Figure 4:
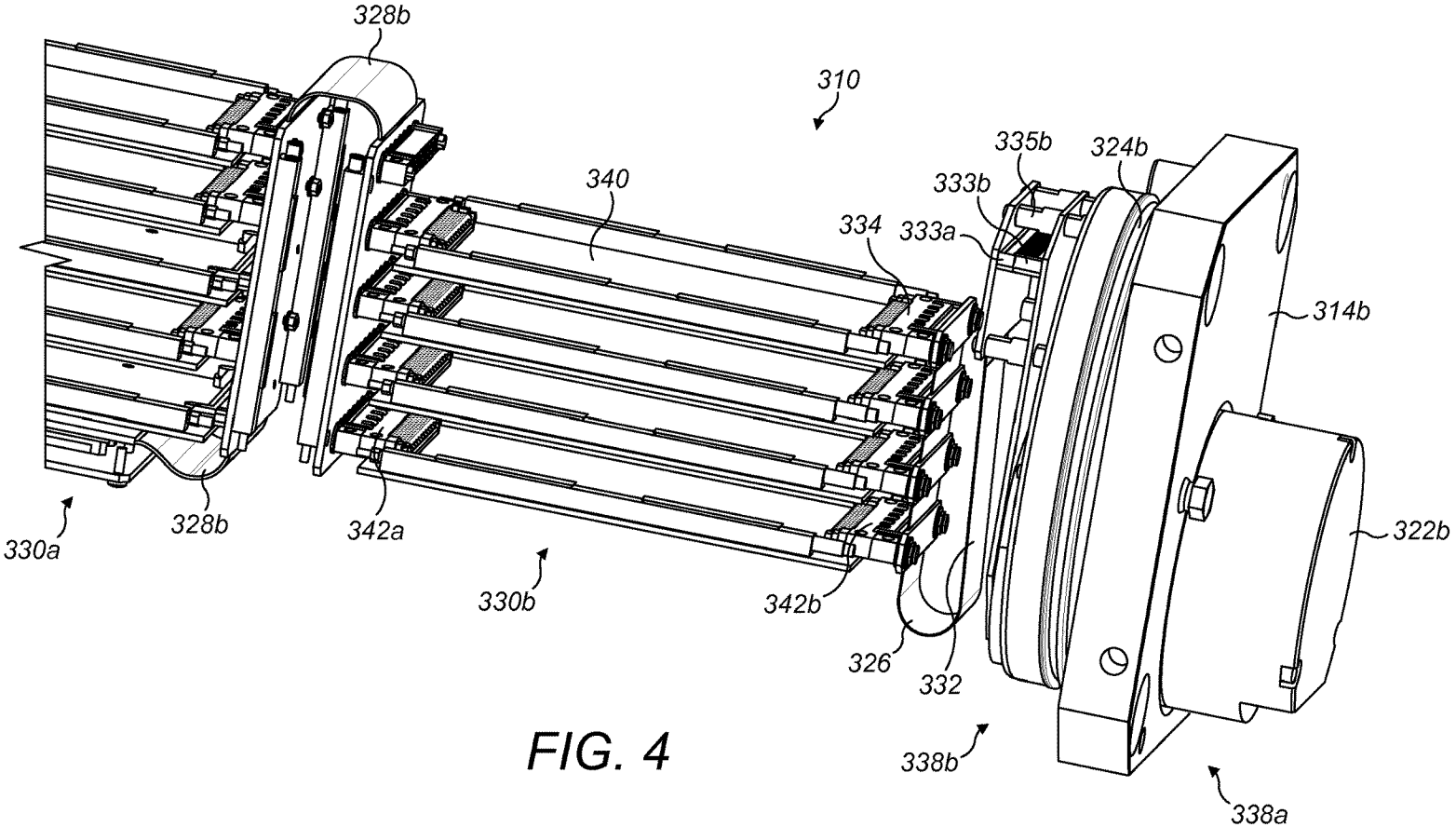
FIG. 4 is a perspective view of electrical components at a second end of the container.

FIG. 4 is a perspective view of the penetrator and electrical components at the right hand side of the apparatus with the canister removed.

The second lid 314*b* contains 267 conducting pins which terminate on the second side 338*a* of the second lid 314*b* in an electrical penetrator 322*b*. The electrical penetrator 322*b* comprises a body housing an aperture containing the 267 conducting pins that are in electrical communication with electrical component 330*b* via the ribbon cable 326. The 267 conducting pins in the second lid 314*b* are in electrical communication with electrical component 330*a* via backplane 328*b*. The electrical penetrator 322*b* of the second lid 314*b* is a dry-mateable connector. The electrical penetrator 322*b* of the second lid 314*b* is an integral part of the second lid 314*b*.

The electrical penetrator 322*b* of the second lid 314*b* is an interface between the inside and the outside of the canister.

The ribbon cable 326 has a first 332 and a second 334 end. The first end 332 of the ribbon cable 326 terminates and is in electrical communication with one female electrical connector 333*a*. The second lid 314*b* has one corresponding male connector 333*b*, onto which the female connector 333*a* is secured, such that electrical communication is established through the ribbon cable 326, the one female 333*a* and one male 333*b* connector and the 267 conducting pins in the second lid 314*b*.

The first end 332 of the ribbon cable 326 also contains four securing screws (not shown) which mate with four corresponding fixing pillars 335*b* on the second lid 314*b*. The securing screws and corresponding fixing pillars 335*b* allow for easier mating of the female connector 333*a* and the male connector 333*b*.

The second end 334 of the ribbon cable 326 is attached and in electrical communication with the second electrical component 330*b*.

Electrical communication between the electrical components 330*a*,330*b* is provided by the backplane 328*b*. The second end 334 of the ribbon cable 326 is in electrical communication with the first electrical component 330*a* via the backplane 328*b*.

The second electrical component 330*b*, or DPC side, contains four PCB's 340. There are two connectors 342*a*, 342*b* attached to each PCB 340. The two connectors 342*a*, 342*b* are attached to opposite ends of each PCB 340. The two connectors 342*a*,342*b* are directly attached and hardwired to the each PCB 340.

The second end 334 of the ribbon cable 326 is in electrical communication with electrical connectors 342*b* on the second electrical component 330*b*.

Figure 5:
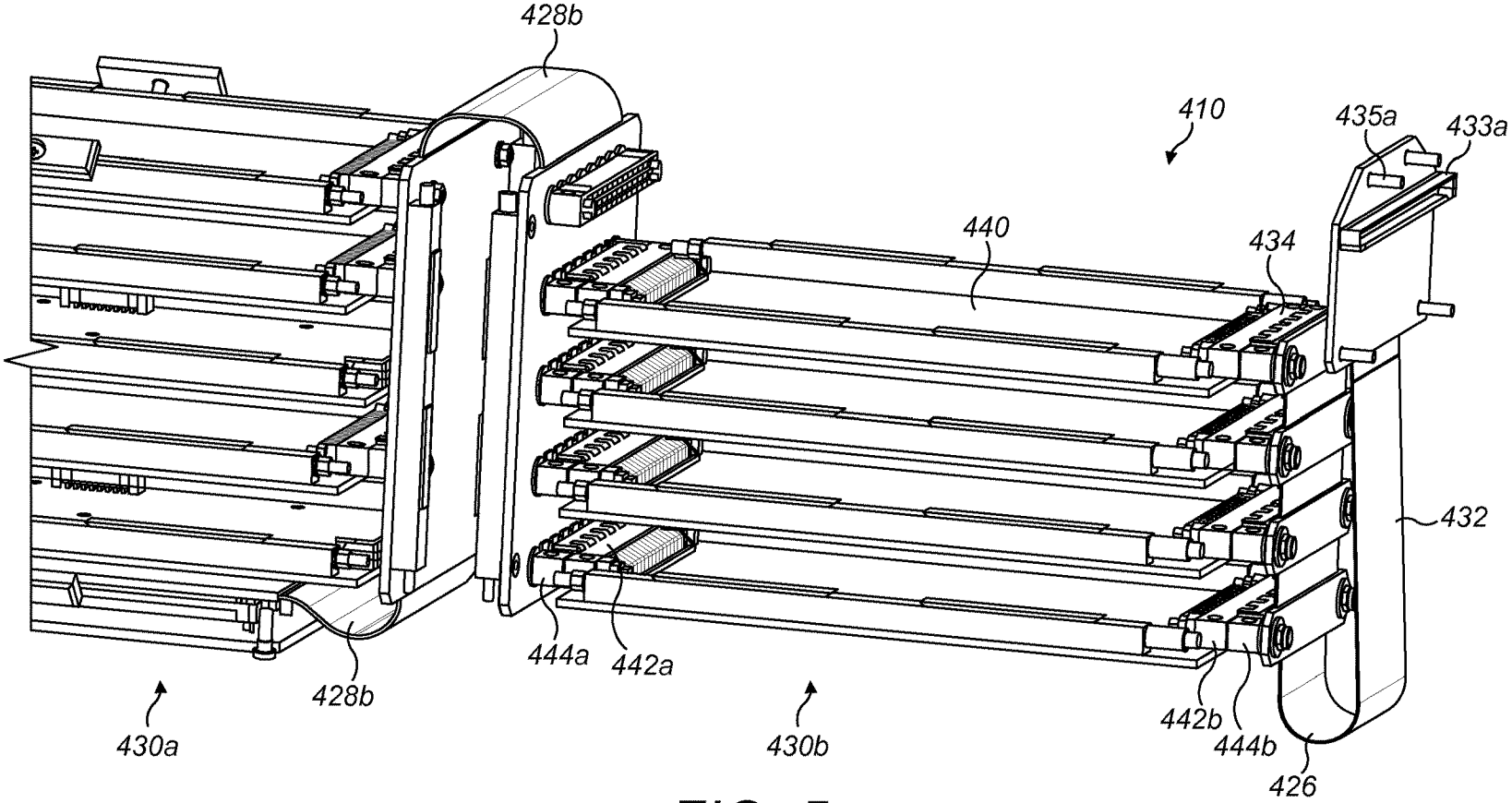
FIG. 5 is a perspective view of wires providing electrical communication between the electrical components in the container and electrical connections in the lid.

FIG. 5 is a perspective view of the ribbon cable providing electrical communication between the electrical components and electrical connections in the second lid. It shows the flexible termination solution for the DPC-side (right side) of the apparatus.

The ribbon cable 426 has a first and a second end 432,434. The first end 432 of the ribbon cable 426 terminates and is in electrical communication with a female electrical connector 433*a*. The first end 432 of the ribbon cable 426 is secured by four securing screws 435*a*. The second end 434 of the ribbon cable 426 is attached and in electrical communication with the second electrical component 430*b*.

Electrical communication between the electrical components 430*a*,430*b* is provided by the backplane 428*b*. The second end 434 of the ribbon cable 426 is in electrical communication with the first electrical component 430*a* via the backplane 428*b*.

The second electrical component 430*b*, or DPC side, contains four PCB's 440. There are two connectors 442*a*, 442*b* attached to each PCB 440. The two connectors 442*a*, 442*b* are attached to opposite ends of each PCB 440. The two connectors 442*a*,442*b* are directly attached and hard-wired to the each PCB 440. The second end 434 of the ribbon cable 426 is in electrical communication with electrical connectors 442*b* on the second electrical component 430*b*.

The apparatus 410 further comprises two connectors 444*a*,444*b* to provide electrical communication between the two corresponding connectors 442*a*,442*b* attached to each PCB 440 and the ribbon cable 426 or backplane 428*b*. The two connectors 444*a*,444*b* are particularly suited to use in harsh environments. The two connectors 444*a*,444*b* are Hypertac(TM) type connectors.

The two corresponding connectors 442*a*,442*b* attached to each PCB 440 are male-type connectors. The two connectors 444*a*,444*b* are female-type connectors. The connector 442*b* and corresponding connector 444*b* are screwed together. The connector 442*a* and corresponding connector 444*a* are held together because each PCB is clamped to the chassis (not shown).

Figure 6:
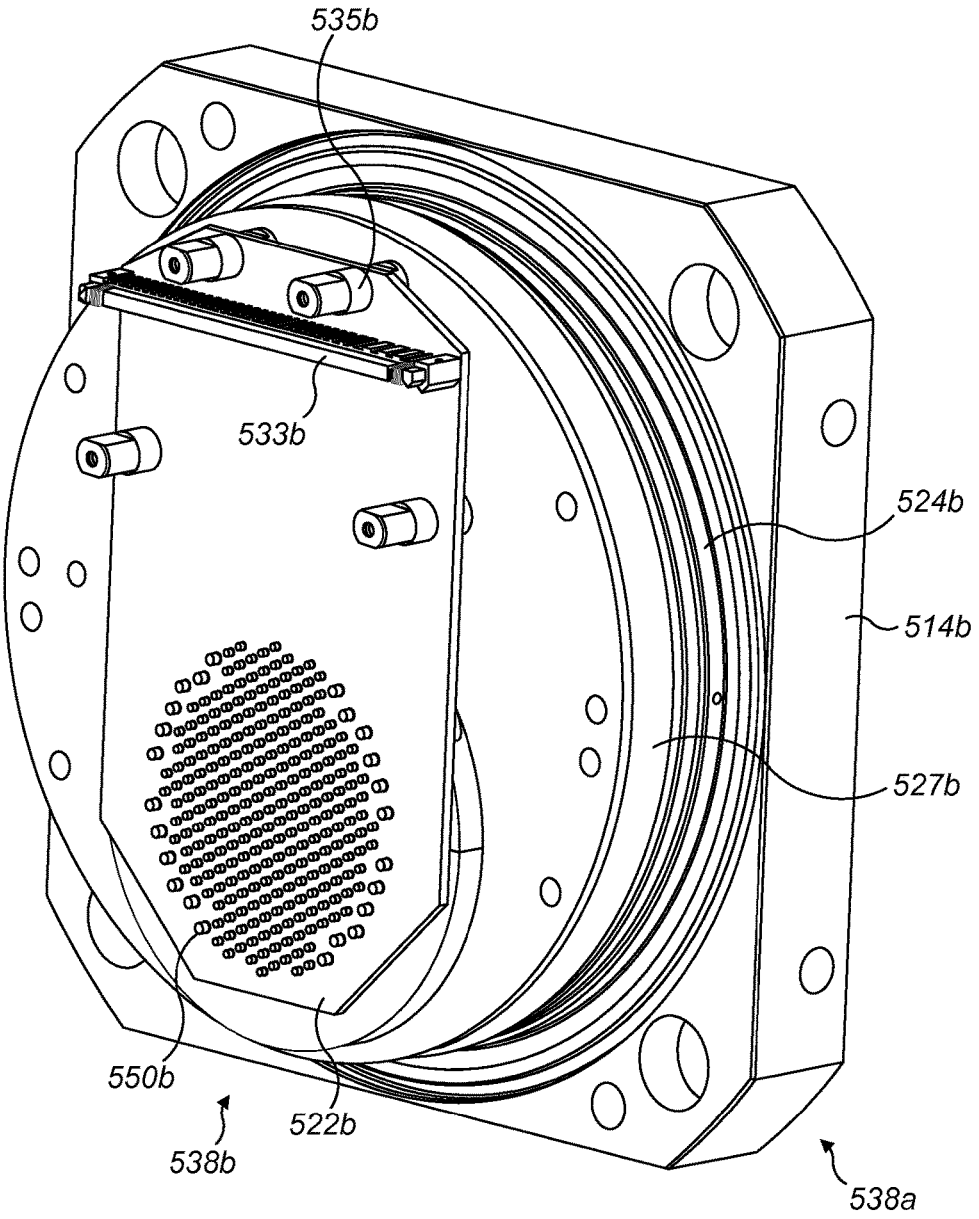
FIG. 6 is a perspective view of the lid and electrical connections in the lid.

FIG. 6 is a perspective view of the lid, electrical connections in the lid and penetrator for the DPC side of the apparatus.

The second lid 514*b* has 267 conducting pins 550*b* to provide electrical communication from a first side 538*b* of the second lid 514*b* to a second side 538*a* of the second lid 514*b*. The 267 conducting pins 550*b* in the second lid 514*b* terminate on the second side 538*a* of the second lid 514*b* in an electrical penetrator 522*b*.

The electrical penetrator 522*b* comprises a body housing an aperture containing the 267 conducting pins 550*b* that are in electrical communication with the electrical components in the canister.

Each of the 267 conducting pins 550*b* communicates an electrical signal. Each electrical signal is a control signal. A control signal is a signal sent from outside the canister to the electrical components in the canister to instruct the electrical components to open a valve or activate an actuator.

The first side 538*b* of the second lid 514*b* comprises a face seal 524*b* extending around the surface of the second lid 514*b* such that it is contactable with an inner surface of the canister near the second aperture of the canister. The first side 538*b* of the second lid 514*b* also comprises a barrel seal 527*b* which is contactable with a flange on the canister near the second aperture.

The second lid 514*b* also comprises four corresponding fixing pillars 535*b*. The four corresponding fixing pillars 535*b* on the second lid 514*b* receive the four securing screws on the first end of the ribbon cable. The second lid 514*b* also has one corresponding male connector 533*b*, onto which the female connector on the first end of the ribbon cable is secured.

Figure 7:
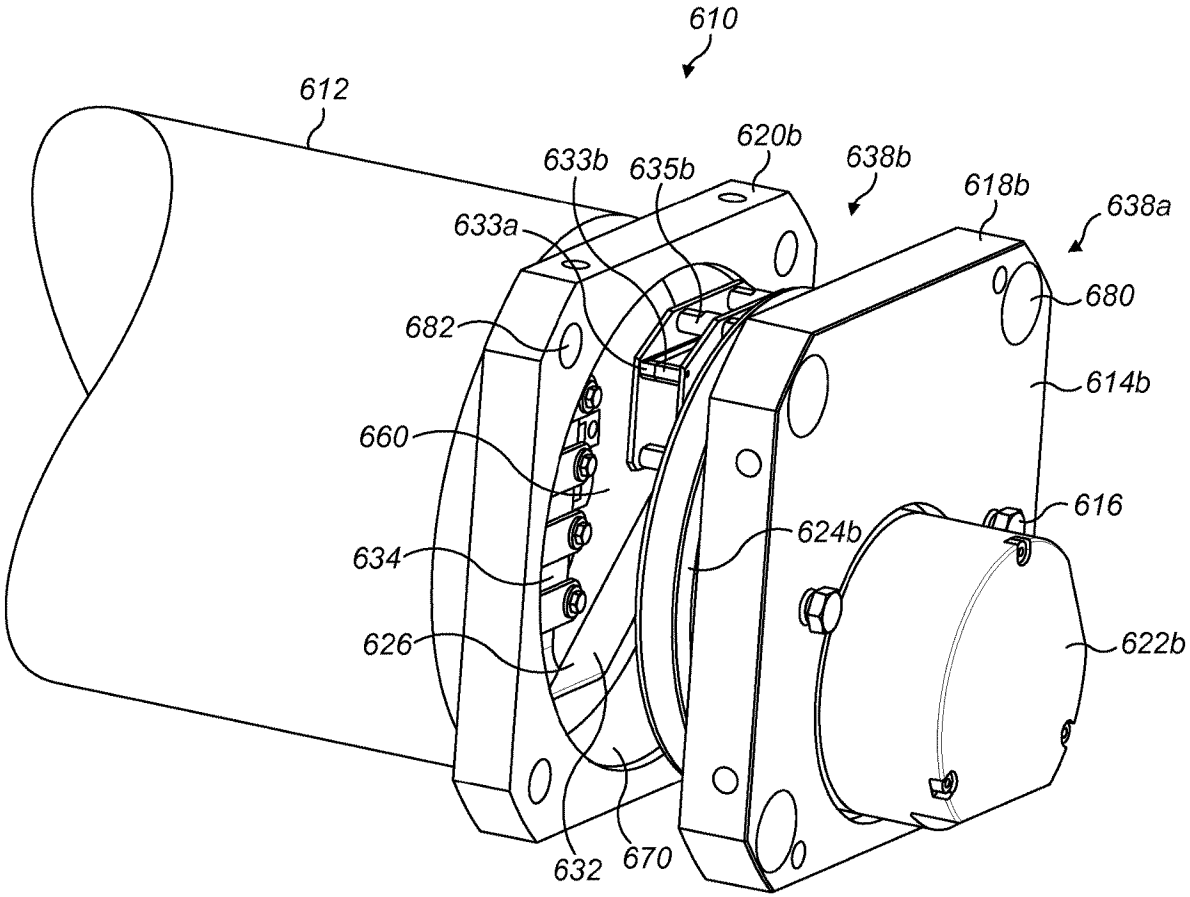
FIG. 7 is a perspective view of the lid being offered up to the container and the wires.

FIG. 7 is a perspective view of the lid comprising the penetrator being offered up to the container as a flexible termination solution for the DPC side (right side) of the apparatus.

The apparatus 610 comprises a canister 612 with flange 620*b*, a second lid 614*b* with penetrator 622*b*, a face seal 624*b*, a barrel seal (not shown), corresponding fixing pillars 635*b* and male connector 633*b*, and a ribbon cable 626 with first end 632 in electrical communication with a female connector 633*a* and second end 634 attached and in electrical communication with the electrical components (not shown) within the canister 612. In use, before the canister 612 is deployed subsea, electrical components are attached and in electrical communication with each other and with a first lid via backplanes (not shown).

The first lid is secured to the chassis (not shown). The electrical components are then inserted into the canister 612 and the first lid is secured to the canister to cover a first aperture (not shown).

The female connector 633*a* in electrical communication with the first end 632 of the ribbon cable 626 is offered up and attached to the male connector 633*b* on the first side 638*a* of the second lid 614*b*. The four securing screws on the first end 632 of the ribbon cable 626 are offered up and attached to the four corresponding fixing pillars 635*b* on the first side 638*a* of the second lid 614*b*.

Once the ribbon cable 626 is attached to the first side 638*a* of the second lid 614*b*, the 267 conducting pins (not shown) in the electrical penetrator 622*b* are in electrical communication with the electrical components (not shown) in the canister 612 via the ribbon cable 626. The second lid 614*b* is then offered up and secured to the canister 612 to cover the second aperture 660. The face seal 624*b*, which extends around a surface of the second lid 614*b*, comes into contact with the inner surface 670 of the canister 612 near the second aperture 660. The barrel seal (not shown), which is located on the flange 618*b*, comes into contact with the flange 620*b* on the canister 612 near the second aperture 660.

When the ribbon cable is connected to the lid 614*b*, the lid 614*b* is movable relative to the canister 612 whilst electrical communication is maintained. This allows the ribbon cable to be connected to the 267 conducting pins in the lid 614*b* before the lid 614*b* is secured to the canister 612, and the canister is prepared for deployment subsea. In use, movement of the second lid 614*b* relative to the canister 612 is only possible with use of a flexible ribbon cable 626, and not with a more rigid backplane.

The second lid 614*b* is attached to the canister 612 by lining up holes 680 in the flange 618*b* of the second lid 614*b* with holes 682 in the flange 620*b* of the canister 612. Bolts are then threaded through both sets of holes 680,682 and nuts used to secure the second lid 614*b* to the canister 612.

The first lid (not shown) is secured to the chassis (not shown) and the first lid and the chassis are then secured to the canister 612 before the second lid 614*b* is secured to the canister 612, in preparation for deployment subsea. Once the first (not shown) and second 614*b* lids are secured to the canister 612, the canister 612 is sealed and air-tight.

Modifications and improvements can be incorporated herein without departing from the scope of the invention.

The invention claimed is:

1. An apparatus for use subsea, the apparatus comprising:

a container having a first aperture and a second aperture at opposing ends of the container;

a lid securable to the container to cover the first aperture, suitable to isolate the inside of the container from the outside of the container when fluid pressure outside the container is at least 5000 kPa;

the lid having one or more electrical connections providing electrical communication from a first side of the lid to a second side of the lid; and one or more wires for providing electrical communication between one or more electrical components in the container and the one or more electrical connections in the lid;

a second lid securable to the container to cover the second aperture, suitable to isolate the inside of the container from the outside of the container when fluid pressure outside the container is at least 5000 kPa;

the second lid having one or more electrical connections providing electrical communication from a first side of the second lid to a second side of the second lid; and one or more backplanes for providing electrical communication between the one or more electrical components in the container and the one or more electrical connections in the second lid.

2. An apparatus according to claim 1, wherein the one or more electrical components in the container are two or more Printed Circuit Board (PCBs).

3. An apparatus according to claim 2, wherein there is at least one connector directly attached to each of the two or more PCBs.

4. An apparatus according to claim 3, the apparatus including at least one corresponding connector to provide electrical communication between the at least one connector attached to each of the two or more PCBs and the one or more wires.

5. An apparatus according to claim 2, wherein the one or more wires for providing electrical communication between the two or more PCBs in the container and the one or more electrical connections in the lid, also provide electrical communication between the two or more PCBs.

6. An apparatus as claimed in claim 2, wherein the two or more PCBs are Digital Processing Card (DPCs).

7. An apparatus according to claim 1, wherein the one or more wires are from 125 mm to 191 mm long.

8. An apparatus according to claim 1, wherein the one or more wires is in the form of a cable.

9. An apparatus according to claim 1, wherein the one or more wires is a flexible cable.

10. An apparatus according to claim 1, wherein the one or more wires is a ribbon cable.

11. An apparatus according to claim 1, the apparatus including one or more other backplanes for providing electrical communication between the one or more electrical components in the container.

12. An apparatus according to claim 11, wherein the one or more backplanes and one or more other backplanes are rigid, semi-rigid, flexi-rigid or flexible.

13. An apparatus according to claim 1, wherein the one or more electrical connections in the lid and second lid terminate on the second side of the lid and second lid in an electrical penetrator.

14. An apparatus according to claim 13, wherein the electrical penetrator of the lid and the second lid comprises a body housing an aperture containing one or more conducting pins that are in electrical communication with the one or more electrical components in the container via the one or more wires and one or more backplanes respectively.

15. An apparatus according to claim 14, wherein the electrical penetrator of the lid and the second lid is the same and has 267 conducting pins in electrical communication with the one or more electrical components in the container via the one or more wires and the one or more backplanes respectively.

16. An apparatus according to claim 1, wherein the lid is suitable to isolate the inside of the container from the outside of the container when fluid pressure outside the container is more than 30,000 kPa.

17. An apparatus according to claim 1, wherein the second lid is suitable to isolate the inside of the container from the outside of the container when fluid pressure outside the container is more than 30,000 kPa.

18. An apparatus according to claim 1, wherein in use the pressure inside the container is from 100 to 200 kPa.

19. An apparatus according to claim 1, wherein the container is gas filled.

20. An apparatus according to claim 1, wherein the apparatus is a Subsea Electronic Module (SEM) used to control one or more of fluid, electrical and other lines that pass through a subsea tree into a subsea well.

* * * * *